United States Patent [19]

Foster

[11] Patent Number: 4,559,656

[45] Date of Patent: Dec. 24, 1985

[54] HOSPITAL BED WITH A WEIGHT-DISTRIBUTING LEVER SYSTEM

[75] Inventor: L. Dale Foster, Brookville, Ind.

[73] Assignee: Hill-Rom Company, Inc., Batesville, Ind.

[21] Appl. No.: 454,000

[22] Filed: Dec. 28, 1982

[51] Int. Cl.[4] ..... A47C 23/06; A61G 7/06

[52] U.S. Cl. ..... 5/236 R; 5/66; 5/68; 5/423; 5/284

[58] Field of Search ..... 5/66–69, 5/90, 236 R, 236 B, 238, 239, 241, 284, 421, 423, 506, 191; 128/70; 297/284, 458, 459

[56] References Cited

U.S. PATENT DOCUMENTS

| | | | |
|---|---|---|---|
| 1,455,239 | 5/1923 | Childress | 5/236 |
| 2,614,273 | 10/1952 | Yancofski | 5/90 |
| 2,616,100 | 11/1952 | Weiner . | |
| 2,638,606 | 5/1953 | Austin | 5/239 |
| 2,924,832 | 2/1960 | Knowles | 5/90 |
| 3,058,778 | 10/1962 | Campbell . | |
| 3,067,438 | 12/1962 | Degen . | |
| 3,081,129 | 3/1963 | Ridder . | |
| 3,176,323 | 4/1965 | Degen . | |
| 3,266,064 | 8/1966 | Figman | 5/284 |
| 3,398,411 | 8/1968 | Douglass | 5/69 |
| 3,546,723 | 12/1970 | Ciampa et al. . | |
| 3,588,930 | 6/1971 | Frisell . | |
| 3,790,150 | 2/1974 | Lippert . | |
| 3,813,713 | 6/1974 | Kipfer . | |
| 3,921,230 | 11/1975 | Hanning et al. | 5/66 |
| 3,999,234 | 12/1976 | Regen . | |
| 4,032,127 | 6/1977 | Lipfert . | |
| 4,033,567 | 7/1977 | Lipfert . | |
| 4,141,585 | 2/1979 | Blackman | 5/423 |
| 4,218,791 | 8/1980 | Hoku | 5/284 |
| 4,222,134 | 9/1980 | Degen . | |
| 4,251,891 | 2/1981 | Degen . | |
| 4,277,858 | 7/1981 | Bohme | 5/66 |
| 4,283,864 | 8/1981 | Lipfert . | |
| 4,380,838 | 4/1983 | Lutchansky | 5/66 |

FOREIGN PATENT DOCUMENTS

| | | | |
|---|---|---|---|
| 270839 | 2/1914 | Fed. Rep. of Germany | 5/236 |
| 831892 | 7/1949 | Fed. Rep. of Germany | 5/236 |
| 1259067 | 1/1968 | Fed. Rep. of Germany . | |
| 075373 | 10/1969 | United Kingdom . | |

*Primary Examiner*—Kenneth J. Dorner
*Assistant Examiner*—Michael F. Trettel
*Attorney, Agent, or Firm*—Burns, Doane, Swecker & Mathis

[57] ABSTRACT

A bed uniformly distributes the weight of a bed-ridden patient to minimize the occurrence of bedsores. The bed comprises a frame and a plurality of support assemblies mounted on the frame. Each support assembly comprises a plurality of elongate support slats extending transversely of the fore-aft direction, and a pair of transversely spaced lever modules carrying opposite ends of the slats. Each lever module comprises a plurality of levers which are so mounted as to be swung in response to the downward action of heavier portions of the patient, whereupon opposite ends of the levers swing upwardly to transfer some of that weight to the lighter portions of the patient's body. The levers disposed on one side of the bed are rotatable relative to the corresponding levers on the opposite side of the bed, whereby the support slats may assume positions inclined relative to horizontal and thereby maintain a greater degree of contact with the patient. The area immediately beneath the slats is vacant, whereby an air-circulating channel can be formed for circulating drying/warming air to the patient. Moisture can gravitate from the patient into the channel and be collected upon a moisture collector for removal. Some of the support modules can be mounted for movement relative to an articulated bed frame in the fore-aft direction to avoid colliding with the frame and/or one another as the bed is articulated upwardly. A highly porous mattress can be utilized which facilitates the upward circulation of air to the patient and the downward gravitation of moisture away from the patient.

30 Claims, 11 Drawing Figures

HOSPITAL BED WITH A WEIGHT-DISTRIBUTING LEVER SYSTEM

BACKGROUND AND OBJECTS OF THE INVENTION

The present invention relates to beds and, in particular, to a patient support system for hospital patients and other bed-ridden patients.

It has long been experienced that persons confined to a bed for prolonged periods tend to become inflicted with decubitus, also referred to as bedsores. These sores, which can have serious implications, result from a combination of conditions. In that regard, a hospital mattress is typically covered by a relatively unyielding surface, such as a thin, tight skin of washable, non-porous vinyl. A human body lying supine on such a surface is supported mainly at four locations, viz., the head, shoulder blades, tailbone, and heels. That is, the supportive forces of the support surface reacting against the body are concentrated in those regions. The resulting high pressures imparted against blood vessels in those regions can cause a disruption in the blood flow and an accelerated death of skin cells normally fed by those vessels. Furthermore, those parts of the body are typically in contact with moisture, such as urine and sweat, the latter being induced by heat which is retained by the non-porous vinyl skin. This moisture further weakens the dead skin and also harbors bacteria. When the dead skin ruptures, as from internal blistering or rubbing movements of the patient against the mattress, the bacteria is able to enter the ruptured skin and cause infections.

It is possible to retard or prevent the formation of decubitus by physically turning the patient on a periodic basis in order to re-establish blood circulation through blood vessels. However, not all hospitals are staffed sufficiently to carry out such a practice in a reliably effective manner. Control over the other sore-contributing factors (e.g., wetness and rubbing) is also difficult to achieve.

It has been recognized that the occurrence of decubitus can be prevented or retarded by reducing the pressure concentrations acting against the body so that the blood vessels are not restricted. Thus, if the supportive forces acting against the body are distributed more evenly, the pressures imposed upon the blood vessels can be reduced to levels below the internal pressures of the vessels, i.e., 30 mm of mercury. At least one effort to achieve such a force distribution, i.e., the so-called Clinitron bed, has achieved success. In such a bed, the patient lies upon a trough of sand which is covered by a rubber sheet. Air is pumped into the trough from below to elevate the sand upwardly against and in conformance with the patient's back so as to minimize the formation of pressure concentrations. Although successful, such beds are highly expensive, and thus have been of restricted usage.

Other proposals for redistributing the patient's weight have included a patient support system comprising a series of fulcrumed levers which act against the patient on opposite sides of their fulcrums. Thus, one end of each lever is acted upon by the downward forces of a relatively heavy portion of the patient's body, whereupon those forces are transmitted as upward forces by the opposite end of the lever. The upward forces act against a lighter portion of the patient's body. Consequently, the weight of the patient is distributed more evenly along the support surface. Arrangements of this type are disclosed, for example, in German Pat. No. 1,259,067 granted Jan. 18, 1968 and in Lippert U.S. Pat. Nos. 3,790,150 and 4,033,567 granted Feb. 5, 1974 and July 5, 1977, respectively.

In FIGS. 1 and 2 of the afore-mentioned German patent, there is disclosed an inclined reclining surface in which the levers are positioned on opposite sides of the bed frame. The levers are arranged as sets of lever assemblies, the assemblies being spaced in the longitudinal direction of the reclining surface. Each lever assembly comprises a series of transverse support rods carried by a pair of transversely spaced lever modules, with the levers of one module being interconnected with the corresponding levers of the other module by transverse bars. Thus, the transverse support rods are constrained, as they move up and down, to remain oriented parallel to the axes of rotation of the various levers.

In the afore-mentioned U.S. Lippert patents, a lever system extends across the entire undersurface of the mattress. The patient support surface is defined by the ends of uppermost ones of the levers.

Such force distributing lever systems are, in theory, capable of more uniformly distributing the patient's weight and thus will reduce the occurrence of pressure concentrations which can close-off the blood vessels. Thus, the incidence of weakened skin areas and the need to repeatedly reposition the patient can be reduced.

However, the other factors contributing to decubitus remain, viz., bacteria-laden moisture conditions and rubbing of the patient's skin (e.g., during raising and lowering of a typical articulated mattress support). It would be desirable to further reduce the influence of these other factors, as well as optimize, to as great a practical extent, the weight distribution which is achieved.

It is, therefore, an object of the present invention to provide a novel bed which reduces the occurrence of decubitus.

A further object is to provide such a bed which avoids the creation of sufficient force concentrations on a patient's body which can disrupt the blood flow in an appreciable number of blood vessels.

A further object is to provide such a bed which isolates the patient from much of the usual moisture such as sweat and urin.

An additional object is to provide such a bed as an articulated-type bed which resists the occurrence of a rubbing action against the patient's body during swinging movements (adjustments) of the articulated mattress frame.

Another object is to provide such a bed which affords a greater degree of movement of the support elements as compared with, say, that of the afore-mentioned German patent.

A further object is to provide such a bed which provides an unoccupied zone beneath the support elements which are capable of receiving various services and/or of conducting an air flow to the patient.

SUMMARY OF THE INVENTION

These objects and advantages are achieved by the present invention which relates to a bed, especially a hospital bed for bed-ridden patients. The bed comprises a frame and a plurality of support assemblies mounted on the frame. The support assemblies are spaced apart in the fore-aft direction of the bed and each support assembly comprises a plurality of elongate support elements and a pair of transversely spaced lever modules carrying opposite ends of the support elements. The support elements extend transversely of the fore-aft direction and are spaced apart in the fore-aft direction. Each lever module comprises a first lever swingable about a transversely extending first axis disposed intermediate its ends. Each lever module also includes a pair of second levers mounted along the first lever on opposite sides of the first axis. Each of the second levers is swingable relative to the first lever about a transversely extending second axis disposed intermediate its ends. The first and second levers of each lever module of the pair of modules are swingable relative to the corresponding first and second levers, respectively, of the other lever module of the pair.

As a result, the downward weight of the patient is uniformly distributed in the fore-aft direction as well as the transverse direction. That is, heavier components of the weight act downwardly against one end of the levers and are transmitted as upward forces by the other end of the levers to provide a greater amount of support than would otherwise be provided. In addition, the opposite ends of the slats are movable relative to one another so as to be able to assume positions inclined relative to horizontal. Thus, for certain positions of the patient, the slats are able to maintain a greater degree of contact with the patient.

It will also be appreciated that the area located immediately beneath the slats is vacant. As a result, the frame can be provided with a non-porous floor and upright walls to define a channel beneath the transverse support elements. An air circulator can be provided which circulates air into the channel and upwardly through the slats to dry and/or warm the patient. In this regard, a blower having a heat exchanger could be employed.

The patient can be laid directly upon the slats or upon a highly porous mattress disposed upon the slats. A mesh-type of member could be positioned between the mattress and the slats to provide support for the mattress. The mesh could be of an anti-friction plastic material so as to be able to slide relative to the slats. The porous nature of the slats, mattress, and/or mesh promotes the circulation of air to the patient, and permits the downward gravitation of moisture away from the patient.

A moisture collector can be disposed within the channel to collect such moisture and can be conveniently replaceable.

By providing for the circulation of drying air to the patient, as well as providing for the gravitation of moisture away from the patient, the presence of bacteria-laden moisture in contact with the patient is greatly reduced, thereby further inhibiting the occurrence of decubitus.

It will be appreciated that each lever module may comprise as many individual levers as is desired. Furthermore, the slats may be pivotably mounted at their ends to the respective levers so as to be pivotable relative to the levers on which they are mounted.

It is desirable to provide the support system upon a bed frame of the articulated type which comprises a stationary seat section, head and thigh sections pivotably mounted to opposite ends of each section, and a leg section pivotably mounted to the thigh section. The present invention provides means for enabling the lever modules to be as long as possible in the fore-aft direction, so as to provide maximum support for the patient, while avoiding the risk that intermediate ones of the lever modules will collide with one another or with the seat section as the articulated frame is raised. In that regard, at least the intermediate ones of the lever modules are mounted so as to be capable of translation relative to the frame in the fore-aft direction in response to the articulation of the frame. That is, as the frame is articulated upwardly, the intermediate ones of the modules move away from each other, and as the frame is articulated downwardly, the intermediate ones of the lever modules are displaced toward one another.

It is desirable to provide means for dampening the movements of the levers of the lever modules. Preferably, the dampener comprises strips of resilient foam plastic which contact at least some of the levers and the slats.

THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF PREFERRED EMBODIMENTS OF THE INVENTION

Figures 1, 2:
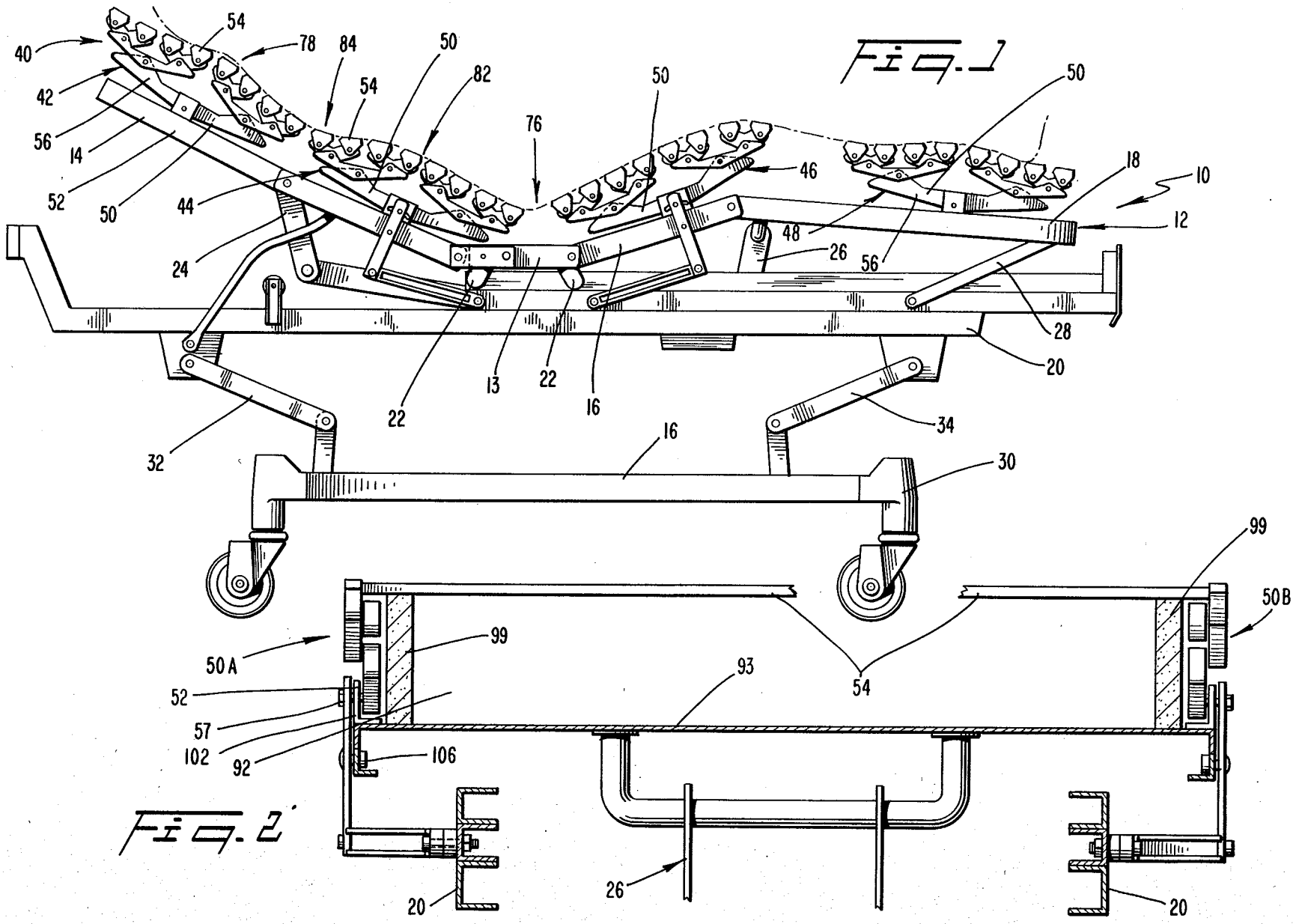
FIG. 1 is a side elevational view of a bed having a patient support system in accordance with the present invention. The bed is of the articulated type and is in an upwardly articulated position with a patient disposed thereon, the head end of the patient being at the left-hand side of the bed.
FIG. 2 is a cross-sectional view taken through a portion of the bed depicting a channel disposed beneath the slats of the patient support system.

A bed 10, depicted in FIGS. 1 and 2, comprises a frame 12 of the articulated type in that it includes a stationary seat section 13 to opposite ends of which are pivotably mounted a head section 14, and a thigh section 16. A leg section 18 is pivotably connected to the thigh section 16. The seat section 13 is fixedly mounted on a carrier 20 by means of connector bars 22, while a plurality of links 24, 26, 28 interconnect the carrier 20 with the head and leg sections 14, 18. The links 24, 26 are power-rotated in the usual fashion (or see U.S. application Ser. No. 06/407,037 of Peck filed Aug. 11, 1982, the disclosure of which is incorporated by reference herein) in order to swing the head and leg sections 14, 18 to various positions of angular adjustment.

The carrier 20 is mounted on a mobile base 30 by means of links 32, 34 which are rotatable in conventional fashion to adjustably raise and lower the carrier 20 and frame 12.

Mounted on the frame 12 is a body support system 40 which includes a plurality of support assemblies 42, 44, 46, 48 spaced apart along the fore-aft dirction of the bed. Each support assembly comprises a cooperating pair of identical lever units or modules 50A, 50B which are spaced apart transversely (see FIG. 2) and connected to respective side edges 52 of the frame 12. Each support assembly also includes a plurality of slat-type support elements 54 which extend transversely between the two transversely spaced modules 50A, 50B.

Figure 3:
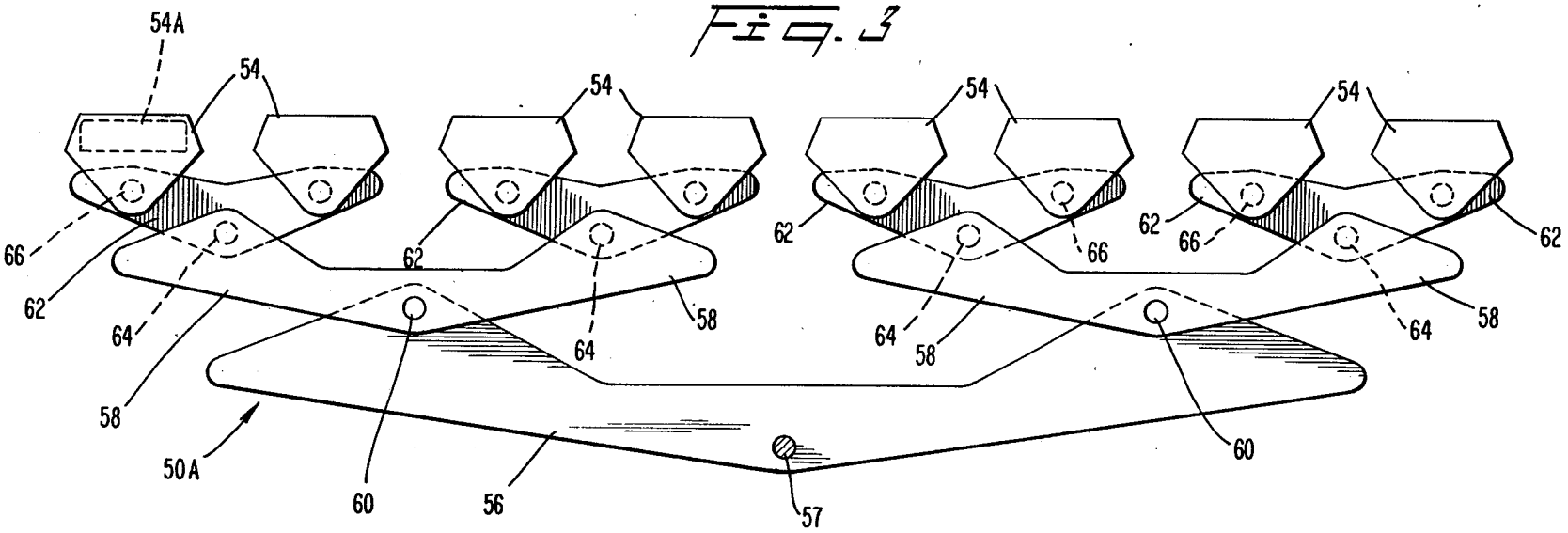
FIG. 3 is a side elevational view of a lever module according to the present invention.
Figure 4:
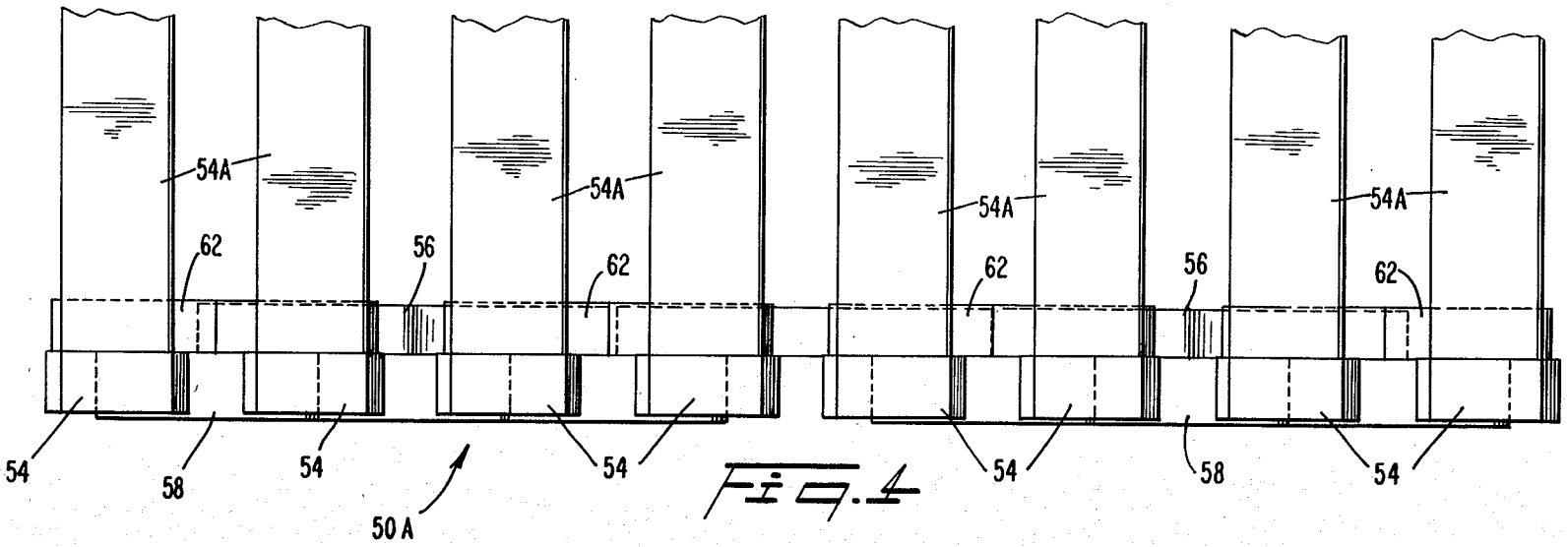
FIG. 4 is a top plan view of one end of a support assembly according to the present invention.

The lever modules 50A, 50B are identical, so only the module 50A is described in detail. This module 50A comprises a first or base lever 56 (FIG. 3) which is pivotably mounted to a respective frame side edge 52 by a horizontal pivot 57 which defines a fulcrum and enables the first lever to swing within a vertical plane disposed parallel to the fore-aft direction.

At the ends of the first lever 56 there are mounted a pair of second levers 58. These second levers are mounted by means of horizontal pivot pins 60 which define fulcrums for the second levers 58. The second levers thus also swing within a vertical plane. This vertical plane can be common to the plane of the first lever 56 or parallel and offset relative thereto, depending upon the manner of mounting the second levers 58. The second fulcrums 60 are disposed on opposite sides of the first fulcrum 57, i.e., are spaced from the first fulcrum in opposite directions in the fore-aft direction.

Mounted at the ends of the second levers 58 are a pair of third levers 62. The third levers 62 are pivotably mounted by means of horizontal pivot pins 64 disposed on opposite sides of the respective second fulcrum. These pivots 64 form third fulcrums about which the third levers 62 rotate in a vertical plane which is common to (or, alternatively, offset and parallel to) that containing the first and second levers.

The first, second, and third levers 56, 58, 62 are formed of a rigid material such as metal, wood, or hard plastic for example, which is capable of transferring forces from one side of the lever to the other.

Each of the third levers 62 carries the ends of two slats 54 by means of horizontal pivot pins 66 disposed on opposite sides of the third fulcrums 64. The other ends of the slats are pivotably carried by corresponding third levers of the other module 50B which is associated with the shown module 50A. It will be appreciated that the corresponding pivot pins of each module 50A are transversely aligned with the pivot pins of its associated module 50B on the other side of the frame 52. The slats 54 are thus able to rotate independently about the pivots 66. It is desirable that the slats 54 be semi-stiff, i.e., formed of a material such as a plastic which is capable of yielding somewhat to conform to the body contour.

Figure 9:
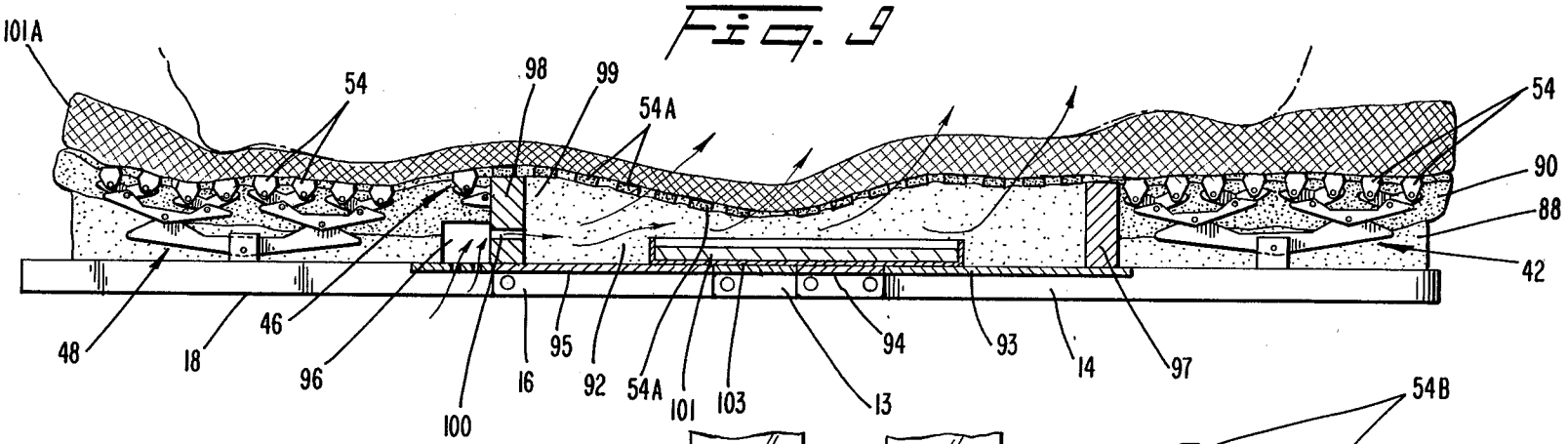
FIG. 9 is a longitudinal sectional view taken through a bed according to the present invention, depicting a channel disposed beneath some of the slats, as well as a moisture collector disposed within the channel.
Figure 11:
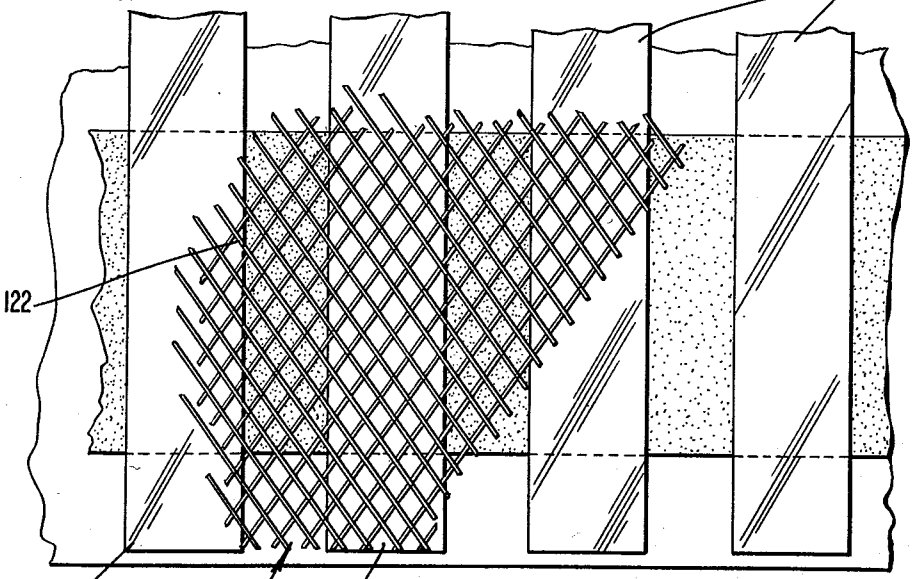
FIG. 11 is a top plan view of one edge of a fragmentary portion of the bed depicting the mesh of FIG. 10 seated thereon.
Figure 10:
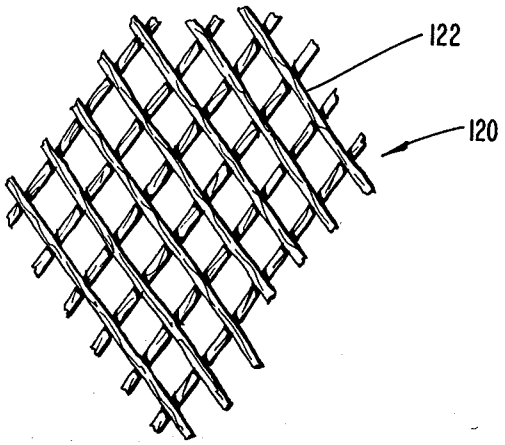
FIG. 10 is a plan view of a screen mesh according to the present invention.

The arrangement of longitudinally spaced slats according to the present invention defines a support surface upon which a human body may be placed in a supine position, as depicted in FIGS. 1 and 9. It is important that the support assemblies 42–48 be arranged such that the first and second fulcrums 57, 60 of the support assemblies are not vertically aligned with any one of the four major weight-concentration regions of the patient's body (i.e., the head, shoulder blades, tailbone, and heels), in order to maximize the ability of the support assemblies to distribute forces (i.e., if a force acts through the pivot of a lever, that lever becomes ineffective as a force transfer device with regard to that force).

Furthermore, the levers 56, 58, 62 on one side of the bed are not interconnected with the corresponding levers on the other side of the bed, i.e., the levers on one side are rotatable relative to the levers on the other side. This maximizes the ability of the slats to conform to the patient's body profile in the transverse direction by assuming positions which are inclined relative to horizontal.

As an example of the force distributing capabilities of the support assemblies, it can be assumed that a patient lies upon the support assemblies in a supine manner. Downward forces imposed on the slats 54 located in the tailbone region 76 are transmitted by the second lever assembly 44 as upward forces to the lower back region 82. In similar fashion, the other support assemblies transfer forces from the higher weight concentration regions to the lower weight concentration regions.

Figure 5:
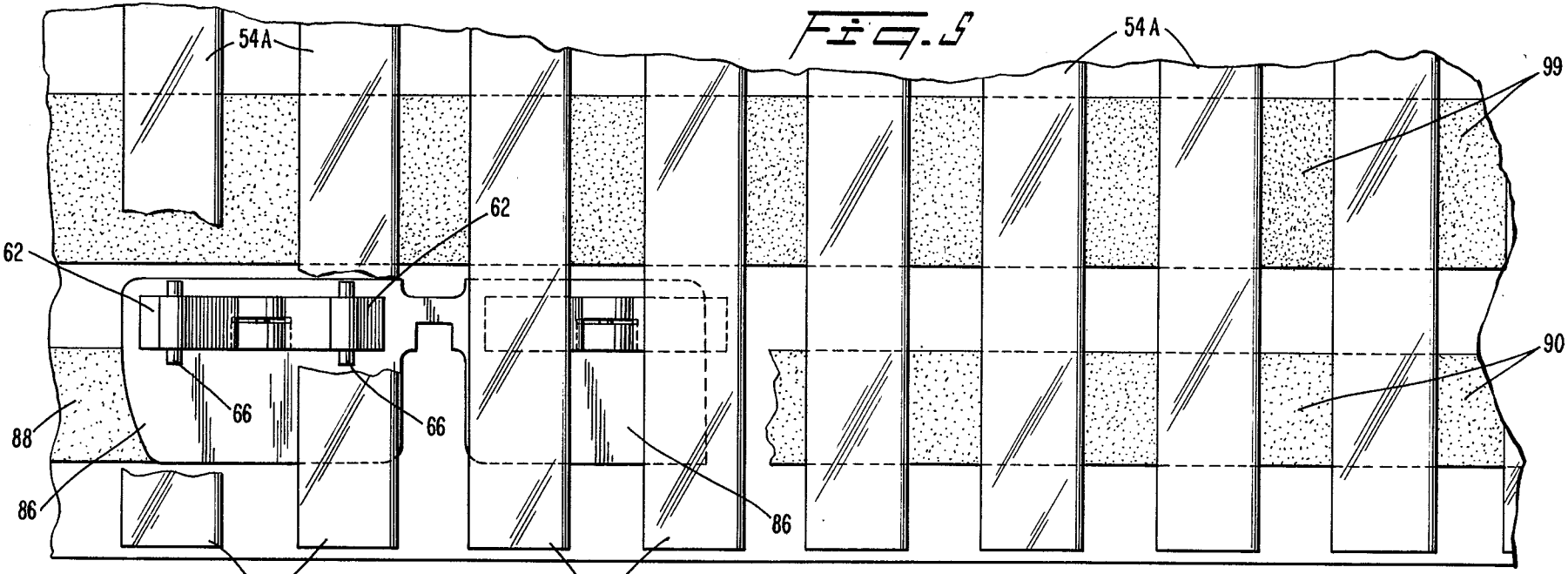
FIG. 5 is a view similar to FIG. 4, in connection with a bed having motion dampener strips for the levers and slats, as well as a channel-defining upright wall adjacent the inner side of the lever modules.
Figure 6:
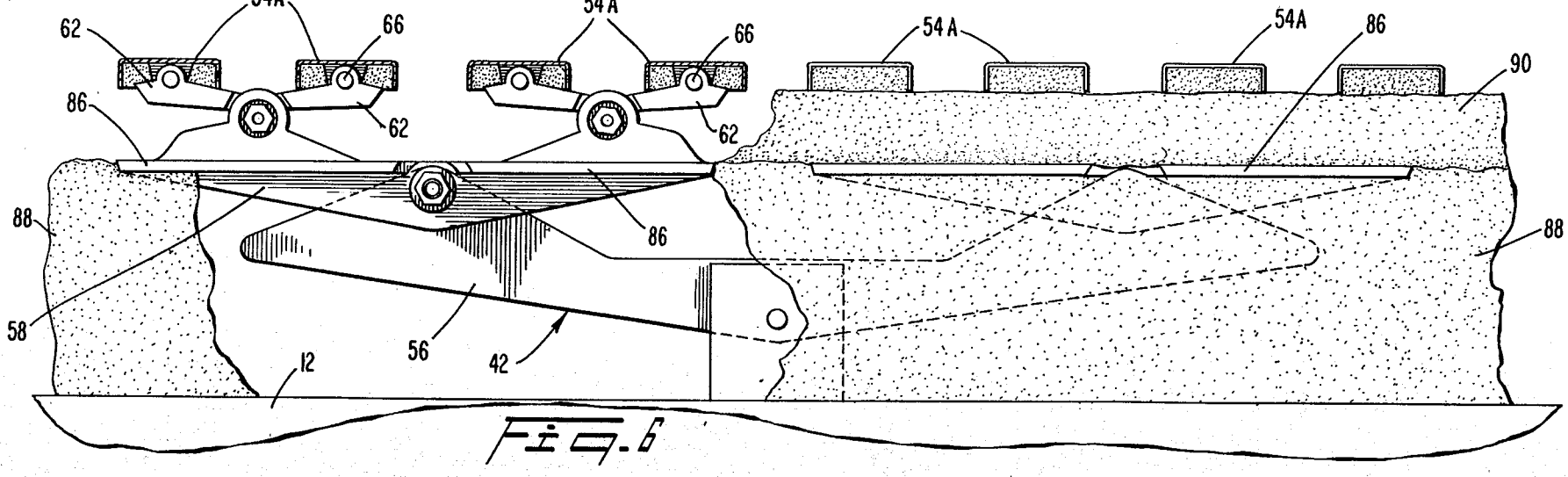
FIG. 6 is a side elevational view of the arrangement depicted in FIG. 5, with portions of the motion damper strips being removed for clarity.

Although not mandatory, it is desirable to provide dampening for the movements of the levers. To this end, there are provided laterally extended protrusions or paddles 86 (FIGS. 5, 6) on the second levers 58. Positioned above and below these paddles 86 are lower and upper strips 88, 90 of a resilient foam material. The paddles 86 are sandwiched between the foam strips 88, 90, while the outer ends of the slats 54A rest upon the top edge of the upper strip 90. The slats 54A depicted in FIGS. 5 and 6 are of slightly different configuration than the slats depicted in FIG. 1 and they extend farther laterally in order to engage the foam dampener 90. Movements of the first and second levers 56 and 58 are dampened by the lower foam strip 90, while movements of the slats 54 and the third levers 62 are dampened by the upper foam strip.

It will be appreciated that the force distribution which is achieved by the lever arrangements 42–48 will significantly resist the occurrence of excessive force concentrations which would otherwise cut-off flow through blood vessels. Hence, one of the factors contributing to decubitus is effectively minimized.

It will further be appreciated that the arrangement of the levers on opposite sides of the bed frame creates a vacant area immediately beneath the slats. In accordance with the present invention there is arranged in this area a structure which forms a fluid channel 91 (FIGS. 2 and 9) This channel forming structure includes a series of generally flat plates 93, 94, 95 which are affixed to the head, seat, and thigh sections 14, 13, 16 of the frame 12. These plates are generally contiguous to define a floor of the channel 92. That is, the plates remain generally aligned with one another even as the frame 12 is being articulated, so as to form a generally continuous, although somewhat irregular channel 92.

One function of the channel 92 is to conduct a flow of air upwardly through the slats 54 in order to warm and/or dry the patient. An air flow may be established, for example, by a blower/heater 96 which can be mounted on the leg section 18 of the frame 12. The channel 92 is provided with an upright front wall 97, an upright rear wall 98, and upright side walls 99 (FIG. 2). The front, rear and side walls are formed by strips of resilient plastic foam. The strips are of a height sufficient to extend upwardly to the slats 54 when the bed is in a horizontal (flat) condition and/or in an articulated condition, occupied or unoccupied. The foam strips can readily deform to conform to the contour of the slats.

The rear wall 98 is provided with one or more openings 100 in order to admit air from the blower 96. This air is constrained to exit the channel 92 only upwardly through the slats 54.

It is also possible to insert a moisture collector within the channel 92 to absorb urin, sweat, sponge-bath drippings, etc. Such a collector may comprise an absorbent pad 101 mounted in a pan 103 formed of resilient plastic material which can be removed for cleaning in any suitable fashion, i.e., by swinging the leg section 18 to an out-of-the-way position, removing the rear wall 98, and sliding-out the pan 103.

Passage of the moisture to the pad 101 is promoted by employing a highly porous mattress 101A (FIG. 9) upon which the patient lies. This mattress can be formed of a washable open-pore polyurethane foam material of the type commonly employed as a medium for filtering, coalescing, demisting, and humidifying. A suitable foam is made by the Foam Division of Scott Paper Co. It will be appreciated that there is no need for a conventional thick, dense mattress to provide comfort since the ability of the slats to conform to the general profile of the patient assures sufficient comfort. In any event, moisture readily seeps through the mattress 101A and is collected by the pad 101.

It is desirable to position the lever modules 42–48 closely together in the fore-aft direction in order to provide maximum support for the patient's body, especially in the area of the patient's tailbone where much of the patient's mass is located. However, this objective is hampered in the case of an articulated-type of bed frame because the middle two lever modules 44, 46 will approach one another as the head and thigh sections 14, 16 of the frame 12 swing upwardly. These modules 44, 46 will engage if positioned too closely together. If, on the other hand, there is provided a gap between the middle two lever modules 44, 46 sufficient to avoid interengagement between those modules, the amount of support provided in the tailbone area is undesirably diminished. This problem is avoided by the present invention wherein the middle two lever modules 44, 46 located on opposite sides of the patient's tailbone are positively displaced relative to the support frame 12 as the latter is articulated between different inclinations.

Figure 7:
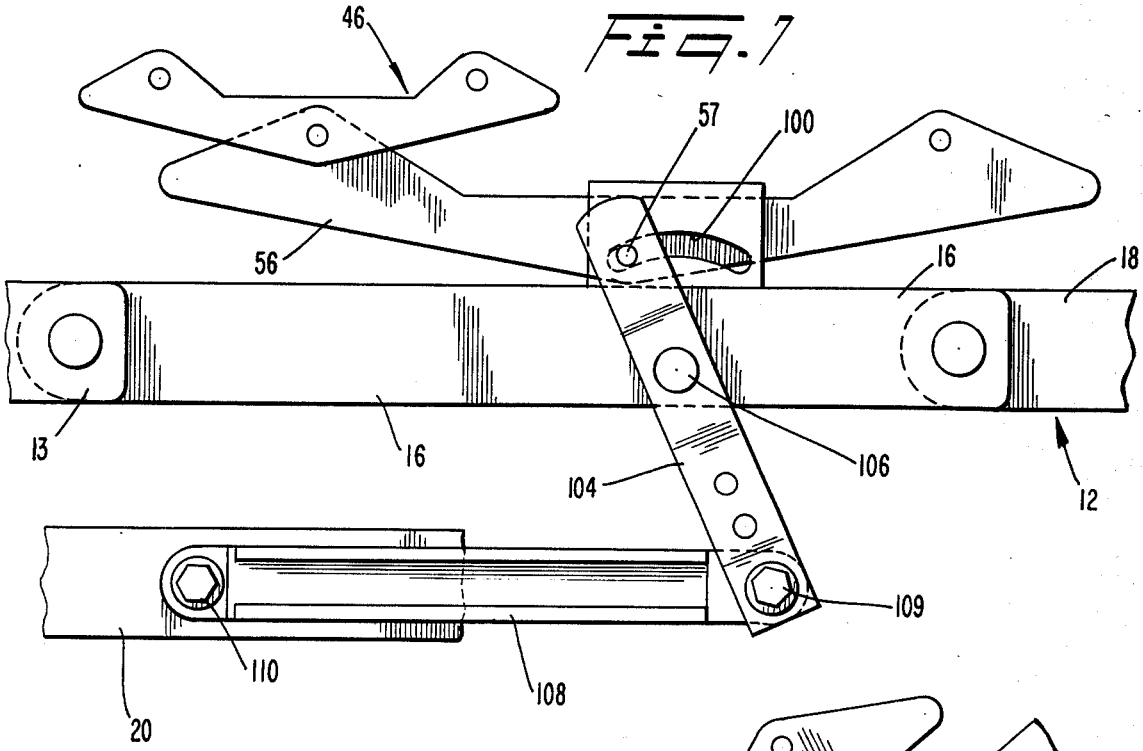
FIG. 7 is a side elevational view of a portion of a lever module, depicting the manner in which a lever module can be mounted for translation relative to the bed frame. The lever module in FIG. 7 is oriented in a position corresponding to a horizontal orientation of an articulated bed frame.
Figure 8:
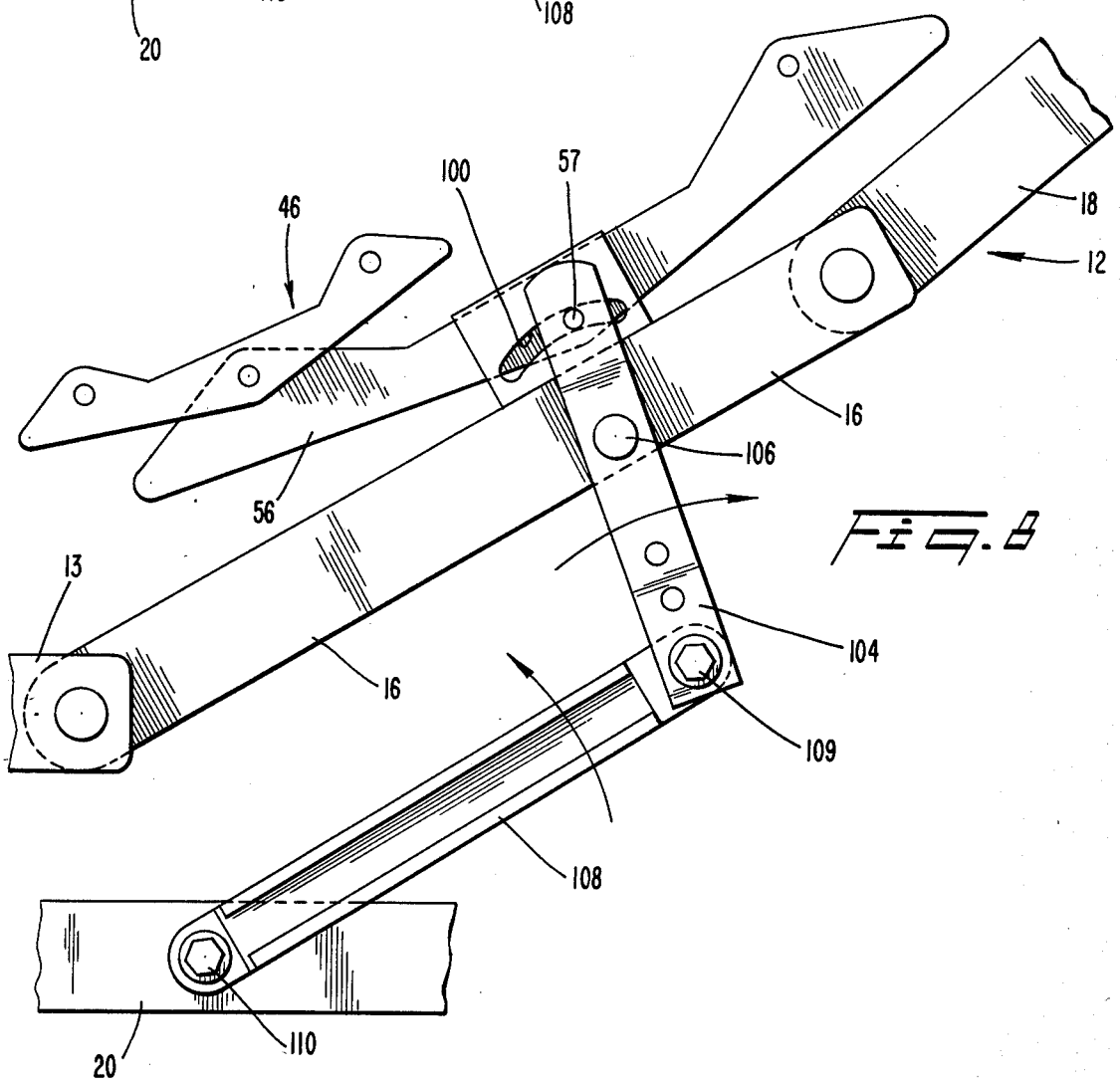
FIG. 8 is a view similar to FIG. 7 depicting a lever module after the articulated frame has been raised and the lever module has been displaced relative to the frame.

This is achieved by arranging the second and third support assemblies 44, 46 for sliding movement relative to the head and thigh sections 14, 16 of the support frame. As can be seen in FIGS. 2, 7 and 8, the main pivot pin 57 of the first lever 56 of both modules 44, 46 is slidably disposed within a slot formed in a bracket 102. The bracket 102 is rigidly fastened to the thigh section 16 of the frame 12. A crank arm 104 is pivotably connected to the thigh section 16 for rotation about a horizontal axis 106. The slot 100 is of arcuate configuration, having a center of rotation which is concentric with the pivot pin 106 of the crank arm 104. One end of the crank arm 104 is pivotably connected to the pin 57 while the opposite end is connected by a pivot pin 109 to a bar 108; at its other end the bar 108 is pivotably connected at 110 to the carrier 20.

It will be appreciated that when the frame 12 is articulated from a horizontal position (shown in FIG. 7), to an inclined position (shown in FIG. 8), the spacial relationship between the pivot axis 106 of the crank arm 104 and the pivot 109 between the crank arm and the bar 108 changes, since the thigh section 16 and the bar 108 rotate about mutually spaced pivots. Hence, the crank arm 104 is caused to rotate about its pivot axis 106, thereby displacing the lever module 46 along the slot 100 in a direction away from the stationary seat section 13 of the frame 12.

As noted earlier, both of the middle two lever modules 44, 46 are provided with crank arms. Each of those modules 44, 46 are displaced away from the seat section 13 and thus from the other module 44 or 46 when the respective frame section 14, 16 is articulated upwardly. Thus, the middle two modules 44, 46 can be dimensioned to extend closely adjacent one another for providing maximum patient support, while avoiding the chance that those modules will collide when the frame is articulated upwardly. The other modules could be similarly mounted, if desired.

A further advantage realized from the displacement of the middle modules 44, 46 involves a reduction in the amount of rubbing against the patient's skin which occurs as the mattress frame is articulated. In this regard, it will be appreciated that as the adjustable sections 14, 16, 18 of the mattress frame 12 are articulated upwardly from an inclined posture, the patient's back becomes more arched (i.e., becomes convexly shaped) and hence the skin stretches. On the other hand, the patient contacting surface of the mattress becomes concavely-shaped and thus contracts. The resulting relative movement between the expanding skin and contracting mattress surface can rupture any weakened skin areas, thus promoting decutibus. However, the displacement of the middle two modules 44, 46 away from the seat section 13 as the mattress frame 12 is articulated upwardly tends to stretch or expand the mattress, thereby counteracting to some extent the contracting tendencies of the patient contacting surface of the mattress.

If an open pore mattress is employed, it is desirable to utilize a backing for the mattress which is positioned between the mattress and the slats 54. Such a backing could be in the form of a plastic mesh 120 formed of plastic strands 122 that are fused at their points of contact. Such strands would be much thicker and stronger than the strands of the mattress and would thus add support for the mattress, as well as somewhat smoothing-out the profile of the slats 54. The mesh could be anchored at the fore-aft ends in a manner preventing transverse movement of the mesh relative to the slats, while permitting a limited amount of relative movement in the fore-aft direction.

It should also be realized that it is feasible to simply position the patient directly upon the slats 54 or the mesh 120, if desired.

It will be appreciated that a bed according to the present invention greatly reduces the occurrence of decubitus by preventing pressure spikes or concentrations which could close-off some of the patient's blood vessels. Thus, frequent repositioning of the patient to reopen blocked vessels is unnecessary. The lever system enables the slats to redistribute the patient's weight in both a fore-aft direction and a transverse direction. That is, since the levers on one side of the bed frame are rotatable relative to their counterparts on the other side, the slats are not constrained to travel parallel to the rotary axes of the levers as in the afore-mentioned German patent. Rather, each slat is capable of movement such that one end is higher than the other side. This could occur, for example, during rolling movements of the patient, and would result in the slats maintaining a high degree of surface contact with the patient in the transverse direction.

Furthermore, the creation of a void space beneath the slats gives rise to many interesting possibilities, including the circulation of air to the patient. This is most helpful in keeping the patient dry and/or warm. By keeping the patient dry, the incidence of decubitus is further reduced since less bacteria is available to enter wounds of the patient. Keeping the patient dry is of great usefulness in the case of patients with severe burns for example. Also, the ability to warm the patient is useful in recovery rooms where temperatures are kept relatively low for various reasons; the need for heating lamps for that purpose would be eliminated.

The vacant area beneath the slats also enables provision to be made for collecting and removing moisture, thereby rendering it feasible to allow moisture to gravitate downwardly from the mattress. This further contributes to a lack of bacteria-laden moisture against the patient and thus further reduces the incidence of decubitus.

It is also possible to utilize the vacant area beneath the slats for the insertion of X-ray equipment directly beneath the patient. In such a case, the slats would be formed of a radio translucent material such as polycarbonate plastic or thin gauge aluminum, for example.

Although the present invention has been described in connection with preferred embodiments thereof, it will be appreciated by those skilled in the art that additions, modificiations, substitutions, and deletions not specifically described, may be made without departing from the spirit and scope of the invention as defined in the appended claims.

What is claimed is:

1. A bed comprising:

a frame including a head section mounted for articulation, motor-driven means for articulating said head section, a plurality of support assemblies mounted on said frame and spaced apart in the fore-aft direction of said bed, at least one of said support assemblies being mounted on said head section, each support assembly comprising:

a plurality of elongate support elements extending transversely of said fore-aft direction and spaced apart in said fore-aft direction, and a pair of transversely spaced lever modules carrying opposite ends of said transverse support elements by a pivotable connection, each lever module comprising:

a first lever swingable about a transversely extending first axis disposed intermediate its ends, and a pair of second levers mounted on said first lever on opposite sides of said first axis, each of said second levers being swingable relative to said first lever about a transversely extending second axis disposed itermediate its ends;

each lever module being interconnected with the other lever module solely by said pivotably connected transverse support elements so that the first and second levers of each lever module of said pair of modules is swingable relative to the corresponding first and second levers, respectively, of the other lever module of said pair.

2. A bed according to claim 1, wherein said first and second axes of each lever module of said pair is aligned with said first and second axes of the other lever module of said pair.

3. A bed according to claim 1, wherein said frame includes non-porous floor means and non-porous upright walls positioned beneath said transverse support elements and between said transversely spaced lever modules to define a channel beneath said transverse support elements.

4. A bed according to claim 3, including air circulating means for circulating air into said channel and upwardly through said transverse support elements.

5. A bed according to claim 4, wherein said air circulating means includes a heater for heating the circulated air.

6. A bed according to claim 4, wherein said air circulating means is mounted on said frame.

7. A bed according to claim 3, including an open pore mattress mounted on said transverse support elements, said mattress conducting air and moisture between said channel and a patient on said mattress.

8. A bed according to claim 3, wherein said upright wall means comprise strips of resilient non-porous plastic foam.

9. A bed according to claim 3, including a moisture collector removably disposed in said channel for collecting moisture falling through said transverse support elements.

10. A bed according to claim 9, wherein said moisture collector comprises an absorbent pad.

11. A bed according to claim 10, wherein said pad is disposed in a flexible container.

12. A bed according to claim 1, wherein each said lever module of said pair includes a pair of third levers mounted on each second lever on opposite sides of said second axis, each of said third levers being swingable about a transversely extending third axis disposed intermediate its ends, said third levers of one lever module of said pair being swingable independently of the third levers of the other lever module of said pair.

13. A bed according to claim 12, wherein said third levers each carry the ends of two of said transverse support elements, the latter each being swingable relative to said third lever about a transversely extending fourth axis.

14. A bed according to claim 13, wherein each of said transverse support elements comprises a flat slat.

15. A bed according to claim 13, wherein said first, second, third and fourth axes are defined by horizontal pivot pins.

16. A bed according to claim 1, wherein said frame comprises a plurality of mutually articulated sections including said head section, and means for adjustably swinging said sections, each of said swingable frame sections carrying at least one of said support assemblies.

17. A bed according to claim 16, wherein both lever modules of at least one of said pair of lever modules have their first levers mounted for translating movement relative to said frame in said fore-aft direction, and means for displacing said first levers in said fore-aft direction in response to articulation of said swingable sections.

18. A bed according to claim 17, wherein said frame includes a non-swingable seat section, the support assemblies disposed immediately adjacent opposite ends of said seat section having their first levers translatable away from said seat section when said swingable sections are swung upwardly.

19. A bed according to claim 1, including means for dampening the movements of said levers.

20. A bed according to claim 19, wherein said dampening means comprises resilient plastic foam engaging at least some of said levers.

21. A bed comprising:

a frame including:

a stationary seat section;

a head section and a thigh section aritculatedly connected to opposite ends of said seat section, and a leg section articulatedly connected to said thigh section, means for articulating said head, thigh and leg sections relative to said seat section, a plurality of support assemblies mounted on said head, thigh, and leg sections, each support assembly comprising:

a plurality of slats extending transversely of the fore-aft direction of the bed, and a pair of transversely spaced lever modules carrying opposite ends of said slats, each lever module comprising:

a first lever pivotable about a transversely extending first axis disposed intermediate its ends, a pair of second levers mounted on said first lever on opposite sides of said first axis, each of said second levers being pivotable relative to said first lever about a transversely extending second axis disposed intermediate its ends, a pair of third levers mounted on each of said second levers on opposite sides of said second axis, each of said third levers being pivotable relative to said second levers about a transversely extending third axis disposed intermediate its ends, and two of said slats being mounted on each of said third levers and defining the sole means of directly interconnecting said third levers, each slat being pivotable relative to its respective third lever about a transversely extending fourth axis;

said first, second and third levers of each lever module of said pair of modules being rotatable relative to the corresponding first, second, and third levers, respectively, of the other lever module of said pair of modules, the ones of said lever modules located immediately adjacent said seat section having their first levers mounted for translating movement relative to said frame, and means for displacing said last-named first levers away from said seat section in response to upward articulation of said head and thigh sections.

22. A bed according to claim 21, wherein said frame includes non-porous floor means and upright walls on at least said seat and thigh sections and positioned beneath said slats to define a channel beneath said slats, and air circulating means for circulating air into said channel and upwardly through said slats.

23. A bed according to claim 21, including means for dampening the movements of said levers and said slats.

24. A bed according to claim 23, including a moisture collector removably disposed in said channel for collecting moisture falling through said slats.

25. A bed comprising:

a frame, a plurality of support assemblies mounted on said frame and spaced apart in the fore-aft direction of said bed, each support assembly comprising:

a plurality of elongate support elements extending transversely of said fore-aft direction and spaced apart in said fore-aft direction, and a pair of transversely spaced lever modules carrying opposite ends of said transverse support elements, each lever module comprising:

a first lever swingable about a transversely extending first axis disposed intermediate its ends, and a pair of second levers mounted on said first lever on opposite sides of said first axis, each of said second levers being swingable relative to said first lever about a transversely extending second axis disposed intermediate its ends;

the first and second levers of each lever module of said pair of modules being swingable relative to the corresponding first and second levers, respectively, of the other lever module of said pair, said frame comprising a plurality of mutually articulated sections, and means for adjustably swinging said sections, each of said swingable frame sections carrying at least one of said support assemblies, both lever modules of at least one of said pair of lever modules having their first levers mounted for translating movement relative to said frame in said fore-aft direction, and means for displacing said first levers in said fore-aft direction in response to articulation of said swingable sections.

26. A bed according to claim 25, wherein said frame includes a non-swingable seat section, the support assemblies disposed immediately adjacent opposite ends of said seat section having their first levers translatable away from said seat section when said swingable sections are swung upwardly.

27. A bed comprising:

a frame, a plurality of support assemblies mounted on said frame and spaced apart in the fore-aft direction of said bed, each support assembly comprising:

a plurality of elongate support elements extending transversely of said fore-aft direction and spaced apart in said fore-aft direction, and a pair of transversely spaced lever modules carrying opposite ends of said transverse support elements, each lever module comprising:

a first lever swingable about a transversely extending first axis disposed intermediate its ends, and a pair of second levers mounted on said first lever on opposite sides of said first axis, each of said second levers being swingable relative to said first lever about a transversely extending second axis disposed intermediate its ends;

the first and second levers of each lever module of said pair of modules being swingable relative to the corresponding first and second levers, respectively, of the other lever module of said pair, and means for dampening the movements of said levers comprising resilient plastic foam engaging at least some of said levers.

28. A bed comprising:

a frame including a stationary seat section, a head section and a thigh section articulatedly connected to opposite ends of said seat section, and a leg section articulatedly connected to said thigh section, means for articulating said head, thigh and leg sections relative to said seat section, a plurality of support assemblies mounted on said head, thigh, and leg sections, each support assembly comprising a plurality of slats extending transversely of the fore-aft direction of the bed, and a pair of transversely spaced lever modules carrying opposite ends of said slats, each lever module comprising a first lever pivotable about a transversely extending first axis disposed intermediate its ends, a pair of second levers mounted on said first lever on opposite sides of said first axis, each of said second levers being pivotable relative to said first lever about a transversely extending second axis disposed intermediate its ends, a pair of third levers mounted on each of said second levers on opposite sides of said second axis, each of said third levers being pivotable relative to said second levers about a transversely extending third axis disposed intermediate its ends, and two of said slats being mounted on each of said third levers, each slat being pivotable relative to said third levers about a transversely extending fourth axis;

said first, second , and third levers of each lever module of said pair of modules being rotatable relative to the corresponding first, second, and third levers, respectively, of the other lever module of said pair of modules, the ones of said lever modules located immediately adjacent said seat section having their first levers mounted for translating movement relative to said frame, and means for displacing said last-named first levers away from said seat section in response to upward articulation of said head and thigh sections.

29. A bed according to claim 28, including means for dampening the movements of said levers and said slats.

30. A bed according to claim 29, including a moisture collector removably disposed in said channel for collecting moisture falling through said slats.

* * * * *